United States Patent [19]

Iding et al.

[11] Patent Number: 4,534,879

[45] Date of Patent: Aug. 13, 1985

[54] SYNTHETIC SURFACTANT FLAKES AND PROCESS FOR MAKING THEM

[75] Inventors: Stephen H. Iding, Cincinnati; Robert H. Callicott, West Chester, both of Ohio

[73] Assignee: The Procter & Gamble Company, Cincinnati, Ohio

[21] Appl. No.: 625,268

[22] Filed: Jun. 27, 1984

Related U.S. Application Data

[63] Continuation-in-part of Ser. No. 509,274, Jun. 29, 1983, abandoned.

[51] Int. Cl.[3] ..... C11D 17/06

[52] U.S. Cl. ..... 252/174; 252/134; 252/553; 252/DIG. 16; 23/293 A; 159/11.1; 159/DIG. 14; 426/457

[58] Field of Search ..... 252/134, 174, 553, DIG. 16, 252/370; 23/293 A; 159/49, 11.1, DIG. 14; 426/457

[56] References Cited

U.S. PATENT DOCUMENTS

| | | | |
|---|---|---|---|
| 3,746,647 | 7/1973 | Peloquin | 252/91 |
| 3,950,275 | 4/1976 | Toyoda et al. | 252/527 |
| 4,156,707 | 5/1979 | Joshi | 264/75 |
| 4,253,993 | 3/1981 | Ramsey et al. | 252/548 |
| 4,278,571 | 7/1981 | Choy | 252/558 |
| 4,308,625 | 1/1982 | Kitko | 4/228 |
| 4,310,434 | 1/1982 | Choy et al. | 252/174.21 |
| 4,417,405 | 1/1983 | Fuller | 34/39 |

FOREIGN PATENT DOCUMENTS 2083188A 3/1983 United Kingdom .

OTHER PUBLICATIONS

*Food Technology,* Lazar & Miers, 8/71, vol. 25, pp. 830–832.

*Journal of Food Science,* Lazar & Rumsey, 1976, vol. 41, pp. 696–698.

*Primary Examiner*—Paul Lieberman

*Assistant Examiner*—Hoa Van Le

*Attorney, Agent, or Firm*—Richard C. Witte; Ronald L. Hemingway; Leonard Williamson

[57] ABSTRACT

A process for making improved synthetic surfactant flakes from a water-wet paste which is dried on a heated roll drum dryer. Hot surfactant flakes are made from drum drying a water-wet paste containing sodium alkyl sulfate (AS), sodium alkyl benzene sulfonate (LAS), and water-soluble inorganic salts, preferably sodium chloride and magnesium chloride blends. The hot flakes are cooled in a low moisture environment having a dewpoint of up to 10° C., e.g., under a dry nitrogen or dry air blanket. The low moisture environment prevents undesirable, insidious hydration and stabilizes the AS/-LAS flakes. The stable AS/LAS surfactant flakes can be used to make more economical, more processable, firmer improved surfactant cakes. One advantage is that cakes made with the flakes of this invention can contain larger amounts of perfume than cakes made with comparable AS/LAS flakes cooled above said dewpoint.

21 Claims, No Drawings

SYNTHETIC SURFACTANT FLAKES AND PROCESS FOR MAKING THEM

RELATED APPLICATION

This is a continuation-in-part of application Ser. No. 509,274, filed June 29, 1983, now abandon.

TECHNICAL FIELD

The present invention relates to a process for making drum dried synthetic surfactant flakes. Synthetic surfactant flakes are a key ingredient to making surfactant cakes for automatic toilet bowl cleaning products. Such cakes are particularly useful in conjunction with a toilet tank dosing dispenser which automatically dispenses a ration of surfactant, perfume, and/or dye, and optionally other ingredients to the bowl of a toilet, responsive to the flushing of the toilet.

BACKGROUND

The technology of drum drying wet synthetic surfactant materials is old. Sodium alkyl benzene sulfonate (LAS) is a notoriously hygroscopic material. Substantially pure LAS flakes are tacky. Sodium alkyl sulfate (AS) flakes are free flowing and have noncaking properties. Mixtures or co-flakes of AS/LAS have varying physical properties.

U.S. Pat. No. 4,253,993, J. C. Ramsey and P. J. Schoner, issued Mar. 3, 1981, for Shampoo in Flake Form, discloses a process comprising drum drying an aqueous slurry of 45–75% sodium alkyl sulfate (AS), monoethanol amide (MEA), sodium sulfate to make a flake containing 40–60% AS, 2–5% MEA and 20–50% sodium sulfate. Although other drying techniques are disclosed, this patent does not teach the use of nitrogen or dry air to cool the drum dried flakes. U.S. Pat. No. 3,950,275, Toyoda et al., issued Apr. 13, 1976, discloses the use of a coating of builders to stabilize spray dried granules of hygroscopic LAS detergent compositions. This patent is cited to show the state of the art.

In the food art low humidity cooling of drum dried food flakes is known. The following references are examples. "Improved drum-dried tomato flakes are produced by a modified drum dryer" which employs low humidity collection zones. M. E. Lazar and J. C. Miers, August, 1971. Food Technology, Vol. 25, p. 830. "Secondary drying of drum-dried thermoplastic foods," M. A. Lazar and T. Rumsey, 1976, J. of Food Sci., Vol. 41, p. 696, is another reference. United Kingdom Pat. Appln. No. 2,083,188, J. F. Fuller, Mar. 17, 1982, discloses that a puree of fresh fruit is dried on a drum to produce flakes, the whole process being carried out under dehumidified atmospheric conditions.

The above prior art does not teach stabilizing drum dried hygroscopic AS/LAS surfactant flake compositions with dry air or nitrogen. Nor does the prior art teach that such AS/LAS coflakes can carry more perfume in solid cake compositions than cakes made with either AS or LAS flakes alone, or AS/LAS coflakes cooled in an environment having a dewpoint over 10° C.

This invention relates to surfactant flakes which can be used to make surfactant cake compositions which are used in automatic dispensing devices. Examples of such cakes are disclosed in U.S. Pat. No. 4,308,625, Kitko, issued Jan. 5, 1982; U.S. Pat. No. 4,310,434, Choy and Greene, issued Jan. 12, 1982; and U.S. Pat. No. 4,278,5671, Choy, issued July 14, 1981, entitled "Surfactant Cake Compositions". The surfactants provide sudsing in the toilet bowl and also serve to disperse other components of the compositions such as dyes, perfumes, organic resins, etc. Anionic surfactants, especially the organic sulfates and sulfonate types, are used in these compositions because of their availability, low cost and dispensing properties.

Water-soluble inert salts such as alkali metal chlorides and sulfates are used in such compositions to act as a "filler" so that the composition can be formed into cakes of desirable size without using excessive amounts of active ingredients. The predominant ingredients of the cake compositions are usually the surfactant, perfume and the filler salt. Anionic, nonionic, zwitterionic or cationic surfactants are used. The surfactant or surfactant mixture should be solid at temperatures up to about 100° F. (40° C.). Anionics and nonionics and mixtures thereof are useful. Anionics are the most preferred.

The prior art anionic surfactant cakes can be described as essentially the water-soluble alkali metal salts, of organic sulfuric reaction products having in their molecular structure an alkyl or an alkylaryl radical containing from 8 to 22 carbon atoms.

A major problem in this art has been short and/or erratic longevity of surfactant cakes. Another problem is related to the incorporation of higher levels of perfume into surfactant cake formulations while maintaining desired firmness.

SUMMARY OF THE INVENTION

Hot, drum dried sodium alkyl sulfate/sodium alkyl benzene sulfonate (AS/LAS) flakes are cooled in a dry gas environment at a dewpoint of 10° C. or below to prevent insidious hydration and to provide improved flakes. The flakes, which are 90% to 99.5% AS/LAS surfactant, are made from a water-wet paste of AS, LAS and NaCl. The paste is dried on a heated roll drum dryer and removed with a doctor blade. The hot flakes are cooled in a low moisture atmosphere. The process steps are summarized as:

1. Forming a 25° C. to 95° C., preferably 38° C. to 66° C., water-wet paste of the AS, LAS, NaCl and, optionally a buffer to adjust the pH of the paste to 7 to 9.5 for rapid processing stability. The paste should have a moisture content of from about 25% to about 60%. The paste is preferably concentrated to about 50% to about 70% solids to improve the efficiency of the drum dryer.

2. Roll drying the heated paste on a heated roll drum dryer at a temperature of 120° C. to 190° C., preferably 150° C. to 175° C., to provide hot flakes having a moisture content of from about 0.1 up to about 1.8, preferably up to about 1.2%, and a thickness of 0.1 to 1.3 mm.

3. Cooling the hot flakes in a dry gas environment having a dewpoint of up to 10° C., preferably below 0° to 4° C. The flakes are cooled to about ambient temperature or below.

The dry gas, preferably dry nitrogen or dry air, must have a dewpoint of less than about 10° C. The improved flakes comprise, in percentages by weight, 90 to 99.5% of a mixture of (1) sodium alkyl sulfate, (2) sodium alkyl benzene sulfonate having a weight ratio of 1:1.5 to 1.5:1, and (3) from 0.5% to 10% of a water-soluble inorganic salt, preferably sodium chloride and/or magnesium chloride. The cooled flakes can have a moisture content of up to about 1.8%, preferably up to about 1.2%. The stabilized flakes can be used to make improved aesthetic cakes which carry more perfume. It has been discovered that the improved AS/LAS flakes consistently yield harder, improved aesthetic perfumed cakes made therewith than comparable cakes made with flakes cooled at higher dewpoints.

DETAILS OF THE INVENTION

Composition

The essential element of this invention is a stable AS/LAS co-surfactant system which has a ratio of 1:1.5 to 1.5:1, preferably about a 1:1 mixture, of the sodium $C_9$–$C_{15}$ alkyl sulfate (AS) and sodium $C_9$–$C_{15}$ alkyl benzene sulfonate (LAS). The most preferred AS is often called lauryl sulfate and is derived from coconut oil, and the most preferred LAS is often called lauryl benzene sulfonate. AS is needed for its solubility and processing properties. LAS is needed for its perfume absorbing property which is desirable in one of the flakes' primary uses. The AS/LAS surfactants, including impurities, are present in the flakes at a level of from 90% to 99.5%, preferably 92% to 95%. The flakes preferably contain 38% to 52% AS, 33% to 47% LAS, 0.5% to 10% NaCl, and less than 1.2% moisture.

A second element is a processing aid, a water-soluble salt, preferably sodium chloride and magnesium chloride, in an amount of 0.5% to 10% by weight of the flakes, preferably from 6% to 8%.

A third element is residual water in an amount up to about 1.2% by weight of the flakes, preferably less than about 1%.

A buffer is highly desirable to improve flake and cake storage stability. The preferred buffer for the surfactant system is sodium carbonate which is added to the wet paste and is present in the flake at a level of from about 0.2% to about 3% part per part of the AS surfactant. Other buffers can be used. The pH of the buffered surfactant flake is from about 7 to about 9.5, preferably 7.5 to 8.5.

All percentages and ratios herein are "by weight" unless specified otherwise. The flake compositions herein will be described with particular reference to their use in conjunction with surfactant cakes for dispensers which dispense the chemicals into the flush water of toilets, although it is to be understood that said flake compositions can be used in other applications where surfactant flakes or solid surfactant cakes are desired.

Process

A wet paste is prepared by mixing the elements of the flakes: AS, LAS, sodium chloride and water, with enough water to bring the total moisture content of the paste to from 40% to about 60% weight of the paste, preferably from 45% to 55%. The presence of sodium carbonate buffer at a level of 0.2% to 3% part per part of AS provides a pH of from 7 to 9, preferably 7.5 to 8.5. This pH allows a more rapid manufacture of stable coflakes using higher temperatures.

The temperature of the paste is raised preferably to from about 25° C. up to about 95° C., more preferably to from 38° C to 66° C. Viscosity of the paste is preferably from 100 to 10,000 centipoises, more preferably from 1,000 to 5,000 centipoises, when measured by a Brookfield rotating viscometer using a No. 3 spindle at a speed of 30 rpm. Sodium chloride is preferably used to adjust the viscosity of the paste. A broad range of viscosity is acceptable as long as the paste can be handled. For further ease of handling and to increase the processing rate, the paste is preferably concentrated in a pre-dryer, preferably a plate and frame heat exchanger or a wiped film evaporator, to a moisture level of 30% to 50%, more preferably about 40%.

Flakes are formed by pumping the paste into the trough between two heated rolls. Most of the water is removed, and a sheet of hot, dried material which forms on the drum is flaked off with a doctor blade. The hot, dried flakes are carefully cooled in a low moisture environment, e.g., under a dry air blanket or a dry nitrogen blanket, to avoid undesirable, insidious hydration. The dry air or nitrogen should have a dewpoint of 10° C. or below. Examples of commercially available equipment used to produce dry air are: (1) Van Air Regenerative Air Dryer, made by the Van Air Systems, Inc., Co., and (2) refrigeration equipment made by King Refrigeration Mfg. Co.

An exhaust system is required to remove excess steam from above and beneath the drum dryer. A drum dryer like the one discussed in the above-cited Lazar & Miers Food Technology publication can be modified for use in the practice of this invention. The rolls on the drum dryer must be hot enough to dry the paste. The preferred temperatures are from 140° C. to 190° C., more preferably 155° C. to 175° C.

Flake thickness is from 0.1 mm to 1.3 mm, preferably from 0.2 mm to 1.0 mm, more preferably from about 0.2 mm to about 0.6 mm. Measurement can be made by any number of devices, for example, a micrometer or a thickness gauge.

Bulk density of the flakes is from 0.08 to 0.24 gm/cc, preferably from 0.11 to 0.16 gm/cc. The term bulk density means that of a mass of flakes when they are poured gently into a volumetric measure.

The flakes can be stored in a sealed moisture-proof container, preferably in a cooler at a temperature below about 10° C.

The flakes have free flowing, noncaking properties.

The Processing Aid Salt

A processing aid is required to make the flake of this invention. The preferred processing aid is a water-soluble inorganic salt. Sodium chloride and blends of magnesium chloride and sodium chloride may be included in the paste at levels of from 0.5% to 10% by weight of the AS/LAS surfactant. Its primary use is to adjust the viscosity and improve the flaking property of the paste.

In a preferred cake made from the coflakes, NaCl and blends of inorganic salts can be included up to about 40%, preferably 20% to 35%. About 26% to about 28% total inorganic salts is optimum for the preferred cake compositions which are set out in Examples II and V. The composition of Example II is used to evaluate the coflakes via a cake's firmness made from them.

The Dyes

Dyes may be included at levels of from about 0.5% to 12%, preferably 1.0% to 5%. It is highly desirable that the cakes have a pH of less than about 8.5 for dye stability. Examples of suitable dyes ar Alizarine Light Blue B (C.I. 63010), Carta Blue VP (C.I. 24401), Acid Green 2G (C.I. 42085), Astrogen Green D (C.I. 42040), Supranol Cyanine 7B (C.I. 42675), Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the patents of Kitko, U.S. Pat. No. 4,200,606, issued Apr. 29, 1980, and U.S. Pat. No. 4,248,827, issued Feb. 3, 1981, both incorporated herein by reference.) C.I. refers to Color Index.

Utility

The flakes of this invention can be used to make improved perfumed solid cakes for toilet water dosing dispensers.

The manufacture of solid cakes from the flakes of this invention is related to the art of forming bars of toilet soap. The flakes are admixed into a homogeneous mass with other raw materials such as perfumes, dyes, etc., and noodled, plodded, extruded, cut or stamped to form uniform bars or cakes. Firm cakes should have a hardness penetrometer value of less than 120, preferably between 40–100, and most preferably about 65 or less.

Cost of raw material and key performance objectives are important factors in any enterprise. It was discovered that the improved AS/LAS coflakes of this invention can carry a larger amount of perfume in a firm cake (11.7% vs. 9.0%) than a cake made with comparable AS/LAS coflakes made under humid conditions outside the scope of this invention. The coflake to perfume ratio for the 11.7% perfumed cake of this invention is 6:1 vs. a ratio of 7.8:1 for coflakes cooled with air having a dewpoint over 10° C. The greater perfume carrying capacity of the improved AS/LAS system has resulted in a reduced weight cake yielding significant surfactant cost savings.

Cakes made of the AS/LAS coflakes of this invention can load and carry more perfume than comparable AS/LAS coflakes or cakes made with AS flakes and LAS flakes or sodium paraffin sulfonate (NaPS) flakes.

The composition of a preferred cake is made with: about 60% of a coflake of AS/LAS having a ratio of about 1:1; 11% perfume; 1.7% dye; 26% total salts; 0.17% $Na_2CO_3$; and less than 1% moisture. About 0.2% talc is put on the surface of the finished cake as a packing aid.

Dispensers

Such cakes are particularly useful in conjunction with a toilet tank dosing dispenser which automatically dispenses a ration of surfactant, perfume, and/or dye, and optionally other ingredients to the bowl of a toilet, responsive to the flushing of the toilet.

In treating toilet flush water with chemicals in order to produce desirable effects such as bowl aesthetics, cleaning, disinfection, deodorization, aerosol reduction, etc., it is desirable that the chemicals be dispensed into the flush water automatically each time the toilet is flushed. Numerous devices which have been designed for this purpose. Exemplary of such devices are disclosed in:

U.S. Pat. No. 4,171,546, Dirksing, issued Oct. 23, 1979;
U.S. Pat. No. 4,186,856, Dirksing, issued Feb. 5, 1980;
U.S. Pat. No. 4,200,606, Kitko, issued Apr. 29, 1980;
U.S. Pat. No. 4,208,747, Dirksing, issued June 24, 1980;
U.S. Pat. No. 4,216,027, Wages, issued Aug. 5, 1980;
U.S. Pat. No. 4,246,129, Kacher, issued Jan. 20, 1981;
U.S. Pat. No. 4,247,070, Dirksing, issued Jan. 27, 1981;
U.S. Pat. No. 4,248,827, Kitko, issued Feb. 3, 1981;
U.S. Pat. No. 4,251,012, Williams et al., issued Feb. 17, 1981;
U.S. Pat. No. 4,253,951, McCune, issued Mar. 3, 1981;
U.S. Pat. No. 4,281,421, Nyquist et al., issued Aug. 4, 1981;
U.S. Pat. No. 4,283,300, Kurtz, issued Aug. 11, 1981;
U.S. Pat. No. 4,302,350, Callicott, issued Nov. 24, 1981;
U.S. Ser. No. 355,984, Mueller et al., filed Mar. 8, 1982; and
European Pat. Appln. 0,005,286, Nyquist, published Nov. 14, 1979, all of which are incorporated herein by reference.

Particularly desirable devices are those comprising a solid cake composition. In this type of device a measured amount of water enters the device during one flush cycle and remains in contact with the cake between flushes, thereby forming a concentrated solution of the composition which is dispensed into the flush water during the next flush. The advantages of such devices are that the chemical composition can be packaged and shipped in more concentrated form than aqueous solutions of the chemicals. Also, the problems of liquid spillage resulting from breakage of the dispensers during shipment or handling is eliminated. Especially preferred devices for automatic dispensing of chemicals from solid cake compositions into the toilet are those generally described in U.S. Pat. No. 4,171,546, Dirksing, issued Oct. 23, 1979; U.S. Pat. No. 4,208,747, Dirksing, issued June 24, 1980; U.S. Pat. No. 4,186,856, Dirksing, issued Feb. 5, 1980. Details of a preferred dispensing means are disclosed in commonly owned U.S. Pat. Appln. Ser. No. 452,543, Dirksing et al. entitled "Article and Method for Maintaining More Even Concentrations of Bleach in a Passive Dosing Dispenser," filed Dec. 23, 1982, incorporated herein by reference.

Perfumes

Perfumes are an important ingredient for surfactant cake compositions. Perfume is usually used at levels of from 5% to 20%, but levels of from 9% to 20% perfumes are preferred. In U.S. Pat. No. 4,246,129, Kacher, issued Jan. 20, 1981 (incorporated herein by reference), certain perfume materials are disclosed which perform the added function of reducing the solubility of anionic sulfonate and sulfate surfactants. At higher levels of perfumes in certain compositions, e.g., around 12% and higher, the softness of the cake could be a serious processing problem. This is particulaly so in compositions based on larger proportions of alkali metal alkyl sulfate surfactants. LAS is a better carrier of perfume in terms of maintaining desired cake firmness; AS provides better cake solubility.

Perfumes are complex compositions. Table 1 shows two acceptable perfumes useful in making cakes from the flakes of the present invention.

TABLE 2

| Perfume Formulas | |
|---|---|
| Component | Weight % |
| 1-A | |
| Isobornyl Acetate | 31.0 |
| d'Limonene | 20.0 |
| 4-Tertiary Butyl Cyclohexyl Acetate | 5.0 |
| Tricyclo Decenyl Propionate | 5.0 |
| Amyl Cinnamic Aldehyde | 8.0 |
| Anisic Aldehyde | 3.0 |
| Iso Cyclo Citral | 1.0 |
| Methyl Nonyl Acetaldehyde | 1.0 |
| Citrathal | 3.0 |
| Benzyl Acetate | 10.0 |
| Patchouli | 3.0 |

TABLE 2-continued

| Perfume Formulas | |
|---|---|
| Component | Weight % |
| Beta Pinene | 1.0 |
| Diphenyl Oxide | 2.0 |
| Gamma Dodecalactone | 0.5 |
| Delta Undecalactone | 0.5 |
| Gamma Methyl Ionone | 1.0 |
| Geranyl Nitrile | 2.0 |
| Labdanum Claire | 2.0 |
| Ligustral | 1.0 |
| Total | 100.0% |
| 1-B | |
| Isobornyl Acetate | 10.0 |
| Lavandin | 15.0 |
| d'Limonene | 20.0 |
| Lemon Oil C.P. | 20.0 |
| 4-Tertiary Butyl Alpha Methyl Hydrocinnamic Aldehyde | 10.0 |
| Methyl Heptine Carbonate | 0.1 |
| Para Cresyl Methyl Ether | 1.0 |
| Anisic Aldehyde | 5.0 |
| Peppermint Oil | 0.5 |
| Phenyl Acetaldehyde Dimethyl Acetal | 2.0 |
| Lauric Aldehyde | 1.0 |
| Iso Hexenyl Cyclohexenyl Carboxaldehyde | 2.0 |
| Methyl Iso Butenyl Tetrahydro Pyran | 0.5 |
| Vetigreen 1% in D.E.P. | 0.1 |
| Ethyl Methyl Phenyl Glycidate | 0.8 |
| Diphenyl Oxide | 1.0 |
| Musk Xylol | 5.0 |
| Methyl Salicylate | 1.0 |
| 1-8-Cineole | 1.0 |
| Aurantiol | 3.0 |
| Ligustral | 1.0 |
| Total | 100.0% |

Cake Firmness

The firmness of the cake is measured by the use of a penetrometer. Acceptable penetrometer reading is around 120, and preferably from 40 to 100, using a Lab-Line Universal Penetrometer equipped with wax penetration needle ASTM D1321, Cat. No. 4101.

Operation

Level base and place 100 gm and 50 gm weights on plunger top. Place bar on cut end beneath penetrometer needle, raised to the zero position. Lower needle (via elevator screw) until needle just touches plug end. Depress trigger for 10 seconds (needle will lower into cake, then release. To read hardness, lower depth gauge bar until it just touches plunger.

Hardness readings are taken directly from the gauge, in units of tenths of millimeters. Penetration decreases as hardness increases, Raise the needle to zero position, remove plug, and record plug temperature.

EXAMPLES

Preferred embodiments of the invention will be illustrated by the following nonlimiting examples.

In the examples below, unless otherwise stated, all AS and LAS references mean sodium lauryl sulfate, and sodium lauryl benzene sulfonate.

EXAMPLE I

This example sets out the procedure for making stable AS/LAS coflakes. The following formula (102 kg batch) was put into a steam-jacket crutcher with agitation and recirculation:

| Ingredients | Parts |
|---|---|
| AS (29% active)* | 74.11 |
| LAS (90% active)** | 22.23 |
| NaCl | 3.18 |
| $Na_2CO_3$ (25% active) | 0.48 |
| | 100.00 |

*EQUEX-S, manufactured by The Procter & Gamble Company, is a 29% solution of sodium lauryl sulfate and 1% additional solids.
**Calsoft F-90 is a 90% sodium alkyl benzene powder with an average alkyl chain length of 11.3, manufactured by Pilot Chemical Co.

This crutcher paste consisted of:

| Ingredients | Parts |
|---|---|
| AS | 21.49 |
| LAS | 20.01 |
| NaCl | 3.18 |
| $Na_2CO_3$ | 0.12 |
| $H_2O$ | 52.24 |
| Misc. solids from AS and LAS | 2.96 |
| | 100.00 |

This paste was heated to 62° C., and had a pH of about 8.7 and a viscosity which varied from 1000 to 5000.

After about 30 minutes of mixing, the paste was concentrated to about 35% moisture in a plate and frame heat exchanger and then pumped to a drum roll dryer, having a temperature of about 160° C., and dried into flakes. The flakes were cooled in a conveyor shoot under a blanket of dry air having a dewpoint of less than 4° C., which was provided by a Van Air Regenerative Air Dryer. The flakes had the following composition:

| Ingredients | Parts |
|---|---|
| AS | 44.55 |
| LAS | 41.48 |
| NaCl | 6.59 |
| $Na_2CO_3$ | 0.25 |
| $H_2O$ | 1.00 |
| Misc. solids | 6.13 |
| | 100.00 |

EXAMPLE II

The flakes of Example I were agglomerated with perfume, additional NaCl, and dye at ambient conditions using the following formula:

| Ingredients | Parts |
|---|---|
| Flakes | 65.6 |
| Perfume | 11.0 |
| NaCl (added) | 21.7 |
| Dye | 1.7 |
| | 100.0 |

The total NaCl in the system was about 26%. It is noted that some NaCl was brought into the system with the flakes.

The composition was mixed well for 7 minutes and plopped and then extruded through a 1.3cm×4.9 cm orifice into strips. During extrusion the composition had a temperature of about 26° C. The strips were then cut into cakes and allowed to cool to ambient temperature. The cakes had a pH of about 9.5.

The cakes had an average finished hardness penetrometer value of 91.

EXAMPLE III

The procedure set out in Example I is followed, except that the paste is heated to 60° C., the pH adjusted to about 8.5, the wet paste concentrated to about 35% solids, the dry roll dryer temperature is about 160° C. and the hot flakes cooled under ambient conditions, dewpoint less than 4° C. The paste dried to a moisture content of about 0.8%.

Solid cakes are made as in Example II. Their average cake firmness is about 80 penetrometer units.

EXAMPLE IV

The same procedure set out in Example III is followed, except that the dewpoint is above 10° C. It is noted that the moisture level in the flakes of this example is less than 1.2%, even less than 1%. Yet, the flakes are inferior. Cakes made from the flakes of this example, following the procedure of Example II demonstrate an average cake firmness of above 100 penetrometer units.

As shown above in Examples III and IV, flakes made under identical conditions, except for the dewpoint conditions for cooling the flakes, resulted in cakes having suitable hardness (Example III) and cakes being unacceptably soft (Example IV).

The addition of water-soluble magnesium salts to the surfactant (AS and LAS) paste mix prior to drum drying can increase the longevity of the cake made from the flakes. Further, the selection of the type of magnesium salt used to achieve this longevity improvement has an important influence on the dissolution characteristics of the cake.

Longevity testing of cakes for automatic toilet bowl cleaning (ATBC) products is typically done in dispensers at water temperatures of 40°, 60°and 80° F. which are respectively about 4.4°, 15.6° and 26.7° C. A performance parameter known as the temperature coefficient (Tc) has been established to describe the difference in longevity (solubility) between the two temperature extremes.

Example $$Tc = \frac{\text{Longevity (days) @ 40° F. and } \times \text{ flushes per day (Fpd)}}{\text{Longevity (days) @ 80° F. and } \times \text{ flushes per day}}$$

where x is in the range 10 to 14

Tc=45 days/21 days=2.14

For ATBC products, it is desirable for the Tc to be as low as possible. In a co-dispensing product this is an important attribute as one of the functions of a surfactant dye solution is to signal the consumer when the active bleach material has been depleted and the product should be replaced. The disolution rate of the bleach tablet is only slightly affected by temperature fluctuations; therefore, the dissolution rate of the surfactant cake should be closely matched to the bleach cake so that they are depleted simultaneously.

When using magnesium salts in surfactant cake formulations containing AS/LAS flakes to achieve improved longevity, it has been learned that it is more appropriate to use $MgCl_2$ than $MgSO_4$, as plugs with the chloride salt have better (lower) Tc values than their sulfate counterparts.

An experiment was performed where different combinations of AS, LAS, sodium chloride and magnesium chloride or magnesium sulfate were used to form surfactant cakes. The purpose of this work was to study the effects of these latter two salts on longevity and temperature coefficient. The formulas and their temperature coefficients are detailed in the following table:

TABLE 2

| Observation | AS:LAS Ratio | $MgCl_2$ Wt. % | $MgSO_4$ Wt. % | Tc Week 2 | Tc Week 3 | Tc Week 4 |
|---|---|---|---|---|---|---|
| Control | 1.00 | — | — | 2.30 | 2.14 | 2.18 |
| 1 | 1.20 | 3.55 | — | 2.29 | 1.80 | 1.69 |
| 2 | 1.20 | — | 3.76 | 2.61 | 2.42 | 2.24 |
| 3 | 1.10 | 2.04 | — | 1.92 | 1.78 | 1.69 |
| 4 | 1.10 | — | 2.16 | 2.57 | 2.23 | 2.13 |
| 5 | 1.05 | 0.99 | — | 2.42 | 1.85 | 1.88 |
| 6 | 1.05 | — | 1.04 | 2.43 | 2.23 | 2.00 |
| 7 | 1.00 | 2.04 | — | 2.04 | 1.76 | 1.69 |
| 8 | 1.00 | — | 2.15 | 2.48 | 1.96 | 1.76 |

Note:
All cakes contained equal amounts of perfume and dye. The temperature coefficients are derived from predicted longevities of the products at the indicated time of the measurement. The amount of cake dissolved over that time period (i.e., 2 weeks) is compared to the initial cake length and the time (days) until complete dissolution is determined.

Observe that in the above cases where the weight percent $MgCl_2$ is roughly equal to $MgSO_4$ that the Tc value is consistently lower for the $MgCl_2$version. It should be noted that the weight percent $MgCl_2/MgSO_4$ is reported on a nonreacted/dissociated basis. It has been theorized that some of the NaAS/-NaLAS is converted to $Mg(AS)_2/Mg(LAS)_2$ in the presence of $MgCl_2$ or $MgSO_4$ during the processing of the paste mix to a dry form. If this is the case, the presence of sodium chloride (a by-product of the above reactions with $MgCl_2$) is important and benefits the dissolution properties in a more advantageous manner than sodium sulfate (a by-product of the above reactions with $MgSO_4$).

EXAMPLE V

Using the procedures set out in Example I, the following flakes were made as follows:

| Crutcher Ingredients | Parts |
|---|---|
| AS (29% active) | 72.44 |
| LAS (90% active) | 21.72 |
| NaCl | 2.27 |
| $MgCl_2.6H_2O$ | 3.08 |
| $Na_2CO_3$ (25% active) | 0.49 |
| | 100.00 |

The crutcher paste consisted of:

| Ingredients | Parts |
|---|---|
| AS | 21.01 |
| LAS | 19.55 |
| NaCl | 2.27 |
| $MgCl_2$ | 1.44 |
| $Na_2CO_3$ | 0.12 |
| $H_2O$ | 52.72 |
| Misc. solids from AS and LAS | 2.89 |
| | 100.00 |

This paste was heated to about 60°-62° C., and had a pH of about 8.7 and a viscosity which varied from 1000 to 5000.

After about 30 minutes of mixing, the paste was concentrated to about 35% moisture in a plate and frame heat exchanger and then pumped to a drum roll dryer, having a temperature of about 160° C., and dried into flakes. The flakes were cooled in a conveyor shoot under a blanket of dry air having a dewpoint of less than 10° C., which was provided by a Van Air Regenerative Air Dryer. The flakes had the following composition:

| Ingredients | Parts |
|---|---|
| AS | 44.00 |
| LAS | 40.94 |
| NaCl | 4.75 |
| $MgCl_2$ | 3.02 |
| $Na_2CO_3$ | 0.25 |
| $H_2O$ | 1.00 |
| Misc. solids | 6.04 |
| | 100.00 |

EXAMPLE VI

Cakes A and B were made using the procedure of Example II and the flakes of Examples I and V, respectively. Note cake formulation of "A" is slightly different from Example II.

| Component | A (Wt. %) | B (Wt. %) |
|---|---|---|
| NaAS | 30.73 | 30.70 |
| NaLAS | 30.66 | 30.69 |
| NaCl | 25.80 | 23.76 |
| $MgCl_2$ | — | 2.04 |
| $Na_2CO_3$ | 0.17 | 0.17 |
| Dye | 1.66 | 1.66 |
| Perfume | 10.98 | 10.98 |
| | 100.00% | 100.00% |
| Longevity @ 60° F., 14 flushes per day | 31 ± 4 | 37 ± 6 |
| Tc (4 week value) | 2.18 | 1.69 |

Notice that the addition of $MgCl_2$ has increased the longevity of the cake without disturbing and possible improving (lessening) the Tc value.

What is claimed is:

1. A process for making improved surfactant flakes from a water-wet paste which is dried on a heated roll drum dryer comprising the steps of:
   A. Forming a 25° C. to 95° C. water-wet paste containing:
      (a) From 20% to 30% of an alkali metal $C_9$–$C_{15}$ alkyl sulfate;
      (b) From 20% to 30% of an alkali metal $C_9$–$C_{15}$ alkyl benzene sulfonate, wherein said (a) and (b) have a weight ratio of 1:1.5 to 1.5:1;
      (c) From 0.5% to 10% of a water-soluble inorganic salt; and
      (d) The balance water;
   B. Forming heat dried flakes from said paste on said heated roll drum dryer, said flakes having a thickness of 0.1 mm to 1.3 mm and a moisture content of up to about 1.2%;
   C. Cooling the flakes to about ambient temperature in a controlled environment having a dewpoint of less than about 10° C.;

wherein said improved surfactant flakes can carry a larger amount of perfume in a firm cake than a comparable cake made from flakes cooled above said dewpoint; and wherein said firm cake contains from 5% to 20% perfume.

2. The invention of claim 1 wherein said paste contains a buffer to maintain a paste pH of from 7 to 9.5 in a 1% solids solution at ambient temperature.

3. The invention of claim 1 wherein said roll drum dryer has a temperature of 140° C. to 190° C. and wherein said dewpoint is from 0° to 4° C.

4. The invention of claim 1 wherein heat dried flakes are cooled under a blanket of dry nitrogen.

5. The invention of claim 1 wherein said heat dried flakes are cooled under a blanket of dry air and wherein the dewpoint is from 0° to 4° C.

6. The invention of claim 1 wherein said wet paste of step (A) is concentrated to 50% to 70% solids for ease of handling.

7. The invention of claim 1 wherein said alkyl sulfate and said alkyl benzene sulfonate have a ratio of about 1:1.

8. The invention of claim 1 wherein said inorganic salt includes sodium chloride which is present in the dried flakes at a level of from about 6% to about 8%.

9. The invention of claim 1 wherein said wet paste is heated to a temperature of 38° C. to 66° C. and concentrated to a moisture level of 30% to 40%.

10. The invention of claim 1 wherein said heated roll drum dryer has a temperature of 150° C. to 175° C. and said flakes have a moisture content of from about 0.5 to 0.8.

11. The invention of claim 1 wherein the flakes have a thickness of 0.2 mm to 0.6 mm, and a moisture content of about 0.5% to 0.8%.

12. The invention of claim 1 wherein said flakes are mixed with from 5% to 20% perfume, 0.5% to 12% dye, and from 0% to 30% water-soluble inorganic salts, plodded, extruded, and formed into cakes having a hardness penetrometer value of from 40 to 100.

13. The invention of claim 12 wherein cake has 9% to 20% perfume and a total inorganic salt content of about 15% to about 30%.

14. The invention of claim 1 wherein said paste is passed through a pre-dryer to reduce the moisture content of the paste to about 30% to 50%.

15. Improved surfactant flakes comprising on a weight percentage basis of from about 38% to about 52% sodium $C_9$–$C_{15}$ alkyl sulfate (AS), from 33% to 47% sodium $C_9$–$C_{15}$ alkyl benzene sulfonate (LAS), from about 0.5% to about 10% water-soluble inorganic salt and less than about 1.2% moisture, said surfactant flakes being made by:
   A. Forming a 26° C. to 93° C. water-wet paste of said AS, LAS and said salt, said paste having a water content of from 40% to 60%;
   B. Forming heat dried flakes from said water-wet paste on a heated roll drum dryer, said flakes having a thickness of from 0.1 mm to 1.3 mm;
   C. Cooling the heat dried flakes to about ambient temperature in a controlled environment having a dewpoint of less than about 10° C.;

wherein said improved surfactant flakes can carry a larger amount of perfume when in a firm cake form than a comparable cake made from flakes cooled above said dewpoint; and wherein said firm cake contains from 5% to 20% perfume.

16. The invention of claim 15 wherein said AS and LAS have a weight ratio of from 0.8:1 to 1:0.8.

17. The invention of claim 16 wherein said ratio is about 1:1.

18. The invention of claim 15 wherein said water-soluble inorganic salt is present in said flake at a level of from about 6% to about 10% by weight.

19. The invention of claim 15 wherein said flake thickness is from 0.2 mm to 0.6 mm.

20. The invention of claim 15 wherein said flakes are made on a roll drum dryer which has a temperature of from 140° C. to 190° C.

21. The invention of claim 20 wherein said roll drum dryer temperature is 150° C. to 175° C.

* * * * *